US011519587B2

(12) United States Patent
Li et al.

(10) Patent No.: US 11,519,587 B2
(45) Date of Patent: Dec. 6, 2022

(54) LAMP INSTALLED THROUGH SCREWING, AND LAMP BODY

(71) Applicant: ETI Solid State Lighting (Zhuhai) Ltd., Zhuhai (CN)

(72) Inventors: Tinghong Li, Zhuhai (CN); Xiongwen Yin, Zhuhai (CN); Zhaorong Liang, Zhuhai (CN); Bingbing Zhou, Zhuhai (CN)

(73) Assignee: ETI SOLID STATE LIGHTING (ZHUHAI) LTD., Zhuhai (CN)

( * ) Notice: Subject to any disclaimer, the term of this patent is extended or adjusted under 35 U.S.C. 154(b) by 0 days.

(21) Appl. No.: 17/499,992

(22) Filed: Oct. 13, 2021

(65) Prior Publication Data

US 2022/0196227 A1 Jun. 23, 2022

(30) Foreign Application Priority Data

Dec. 23, 2020 (CN) ..... 202023161862.2

(51) Int. Cl.

| | |
|---|---|
| ***F21V 21/04*** | (2006.01) |
| ***F21V 23/02*** | (2006.01) |
| ***F21V 17/12*** | (2006.01) |
| *F21W 131/30* | (2006.01) |
| *F21V 17/16* | (2006.01) |

(52) U.S. Cl.

CPC ..... *F21V 21/043* (2013.01); *F21V 17/12* (2013.01); *F21V 23/023* (2013.01); *F21V 17/166* (2013.01); *F21W 2131/30* (2013.01)

(58) Field of Classification Search

CPC ..... F21S 8/026; F21V 17/12; F21V 17/166; F21V 21/043; F21V 23/023; F21W 2131/30; E04B 9/006

See application file for complete search history.

(56) References Cited

U.S. PATENT DOCUMENTS

| | | | | |
|---|---|---|---|---|
| 9,982,855 | B1 * | 5/2018 | Tan | F21V 21/28 |
| 10,054,273 | B1 * | 8/2018 | Tan | F21S 8/026 |
| 10,731,830 | B2 * | 8/2020 | Feit | F21V 21/04 |
| 10,816,150 | B1 * | 10/2020 | Hsu | F21S 8/043 |
| 11,236,890 | B2 * | 2/2022 | Feit | F21V 21/04 |
| 2005/0183344 | A1 * | 8/2005 | Ziobro | F21V 21/04 52/20 |
| 2012/0267139 | A1 * | 10/2012 | Sartini | F21V 23/026 174/61 |
| 2013/0010476 | A1 * | 1/2013 | Pickard | F21V 17/10 362/311.03 |
| 2016/0320007 | A1 * | 11/2016 | Araki | F21V 19/004 |
| 2017/0059102 | A1 * | 3/2017 | Grant | F21S 8/026 |
| 2017/0307143 | A1 * | 10/2017 | Shah | F21K 9/237 |
| 2020/0080709 | A1 * | 3/2020 | Boulanger | F21S 8/03 |
| 2021/0364151 | A1 * | 11/2021 | Schoepf | H02G 3/20 |

* cited by examiner

*Primary Examiner* — Zheng Song

(74) *Attorney, Agent, or Firm* — Gregory M. Howison

(57) ABSTRACT

The present application relates to a lighting field and discloses a lamp installed through screwing, and a lamp body. The lamp installed through screwing includes a lamp body and an installing bracket. The lamp body is provided with a first fastening part thereon. The installing bracket is provided with a second fastening part thereon. The first fastening part is configured to be inserted into the second fastening part, and the lamp body is screwed, and the first fastening part rotates to fixedly fit the second fastening part. The first fastening part fits the second fastening part through screwing, thereby achieving a quick installation and disassembly.

9 Claims, 5 Drawing Sheets

LAMP INSTALLED THROUGH SCREWING, AND LAMP BODY

CROSS-REFERENCE TO RELATED APPLICATIONS

This application claims priority to Chinese Patent Application No. 202023161862.2, filed on Dec. 23, 2020, entitled LAMP INSTALLED THROUGH SCREWING, AND LAMP BODY, the specification of which is incorporated by reference herein in its entirety.

TECHNICAL FIELD

The present application relates to the lighting field, in particular, to a lamp installed through screwing and a lamp body.

BACKGROUND

In daily life, the lamps are dispensable for people. In use of various lighting lamps, for example, in home use of the lamps, installation locations of the lamps are generally reserved and fixed, and all power lines are reserved at those locations. However, it is trouble to remove the lamp when it is damaged. For example, the lamp shade of the lamp should be removed and then the bolt should be screwed off, thus greatly increasing the complexity of the replacement of the lamp.

SUMMARY

An objective of the present application is to provide a lamp installed through screwing and a lamp body to address the disadvantage of the prior art and to achieve quick installation and disassembly.

The technical solutions are specifically as described below.

A lamp installed through screwing includes a lamp body and a installing bracket. The lamp body is provided with a first fastening part thereon. The installing bracket is provided with a second fastening part thereon. the first fastening part is configured to be inserted into the second fastening part, the lamp body is screwed, and the first fastening part rotates to fixedly fit the second fastening part.

During the installation of the lamp, the installing bracket is firstly fixed at the installation location. After the installing bracket is installed, the first fastening part of the lamp body is positioned to be aligned with the second fastening part of the installing bracket and then inserted into the second fastening part. Thereafter, the lamp body is screwed. The rotation of the lamp body drives the first fastening part to rotate, and the first fastening part rotates to fixedly fit the second fastening part, thus the installation of the lamp body is completed. During the replacement of the lamp body, since the installing bracket has been installed previously in the installation process, the lamp body may be directly fixed by screwing without using any bolt, thus greatly saving the installation time and facilitating the installation.

The lamp body includes a lamp shade, and a lamp source component fixedly connected to the lamp shade. The lamp shade can ensure the aesthetic appearance of the lamp body. Moreover, the configuration of the present solution avoids directly removing the lamp shade and then fixing the lamp body to the installing bracket via the bolt. In the manner of using the bolt, not only the screwing is troublesome, but the installation may be performed only after the lamp shade is removed. Therefore, the configuration of the present solution has prominent advantages.

The first fastening part fits the second fastening part by means of a press. The fit manner by means of a press may increase the friction force of between the first fastening part and the second fastening part, thus effectively preventing them from being loose.

The second fastening part is provided with a hole region and a protrusion region. The first fastening part passes through the hole region and then screwed to fit the protrusion region by means of a press. The first fastening part passes through the hole region and then is screwed to fit the protrusion region by means of a press, thereby completing the fixation.

The lamp body is provided with a protruding installation chamber thereon. The first fastening part protrudes along a perimeter wall of the installation chamber. A dodging hole 22 is defined at the center of the installing bracket. The hole region is provided on a side wall of the dodging hole. The installation chamber passes through the dodging hole, the first fastening part passes through the installing bracket along the hole region. The lamp body rotates to have the first fastening part fit the protrusion region by means of a press. The installation chamber may be provided with a circuit board therein and then electrically connected to the outside via power lines. During the installation, the installation chamber passes through the dodging hole, and then the first fastening part arranged outside the installation chamber passes through the hole region and then is screwed to press the protrusion region to complete the fit.

The first fastening part has a first end and a second end arranged along a rotating direction of the lamp body. A thickness of the first fastening part is gradually increased from the first end to the second end. The second end is provided with a jagged structure thereon. When the protrusion region of the second fastening part fits the first fastening part, the second fastening part passes the first end first, and continues to rotate, the pressure between the second fastening part and the first fastening part becomes larger, and thus the friction force therebetween becomes larger, and the clamping effect is better. When the first fastening part moves to the second end of the second fastening part, the jagged structure fits the first fastening part, thereby preventing the first fastening part from sliding easily.

A protruding rib is punched on the installing bracket. The rib forms the protrusion region. When the first fastening part fits the second fastening part, the jagged structure of the second end presses against the rib. The rib is resilient. The rib has resilience due to the property of the metal itself. Therefore, the rib has the resilience when it presses against and fits the first fastening part, thus preventing the sliding between the first fastening part and the second fastening part.

The lamp installed through screwing further includes an installing seat configured to be fixed onto a wall, on which the lamp is installed. The installing bracket is fixedly installed on the installing seat. The installing seat is used to be installed in advance before the installing bracket is fixedly installed on the installing seat. The installing seat may also be used to receive the reserved power lines The lamp body includes the lamp shade and the lamp source component fixedly connected to the lamp shade. The protruding installation chamber is disposed on the lamp source component. The protruding first fastening part is disposed along the perimeter wall of the installation chamber.

Two protruding lugs are symmetrically disposed on the lamp source component, each of the protruding lugs is provided with a torsional spring thereon. The protruding lugs are directly installed at the reserved location on the lamp source component, and then the torsional springs are installed and configured to mount a downlight.

BRIEF DESCRIPTION OF THE DRAWINGS

The accompanying drawings herein illustrate the specific examples of the technical solution in the present application, and together with the detailed description, constitute a part of the specification to explain the technical solution, principle, and effect of the present application.

Unless expressly specified and defined otherwise, the same reference numeral in different figures may be used to denote same or similar technical features. However, sometimes different reference numerals may be used to denote same or similar technical features.

DESCRIPTION OF REFERENCE NUMERALS

Figure 1:
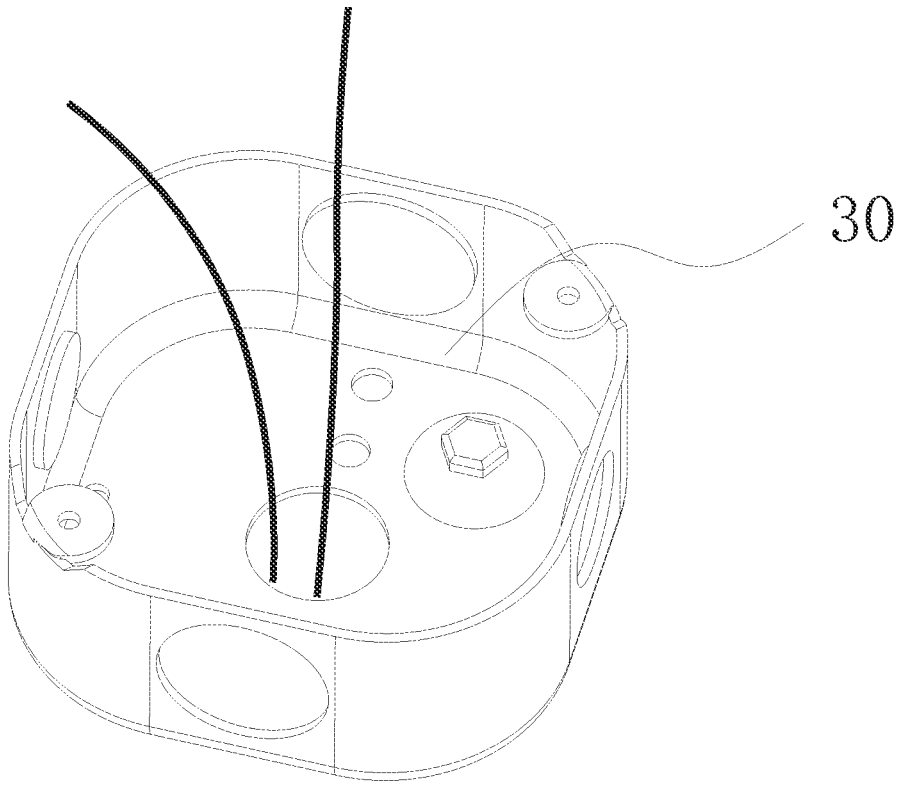
FIG. 1 is a schematic perspective structural view of an installing seat according to an embodiment of the present application.
Figure 2:
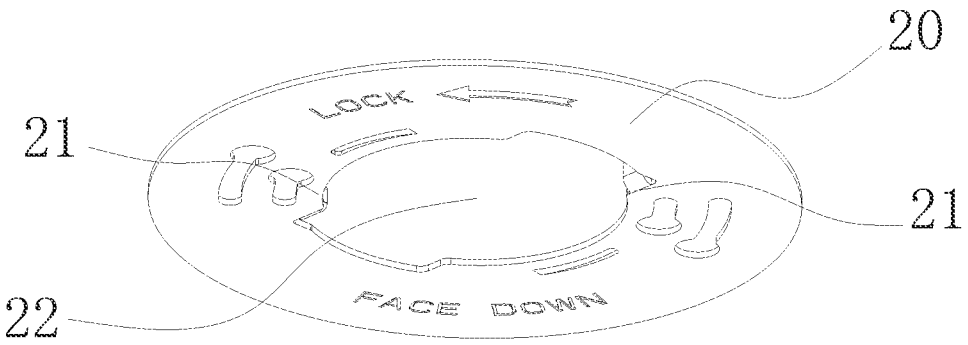
FIG. 2 is a schematic perspective structural view of an installing bracket according to an embodiment of the present application.

10—lamp body
11—first fastening part
111—first end
112—second end;
13—lamp shade
14—lamp source component;
141—protruding lug
142—torsional spring
20—installing bracket;
21—second fastening part
211—hole region
212—protrusion region;
22—dodging hole
30-installing seat.

DETAILED DESCRIPTION

For ease of understanding, the specific embodiments of the present application will be described in detail below with reference to the accompanying drawings.

Unless expressly specified and defined otherwise, all technical and scientific terms used herein have the same meaning as commonly understood by one of ordinary skill in the art to which this application belongs. In case of combining the technical solutions of the present application with the reality scene, all technical and scientific terms used herein can also have the corresponding meaning for achieving the objective of the technical solution of the present application.

Unless expressly specified and defined otherwise, terms such as "first" and "second" are only used herein to distinguish different terms, and do not indicate specific number or order.

Unless expressly specified and defined otherwise, the term "and/or" used herein includes any one or all of combinations of one or more related listed items.

It will be understood that when an element is referred to as being "fixed to" another element, it can be directly fixed to the other element, or intervening elements may be present; when an element is referred to as being "connected to" another element, it can be directly connected to the other element, or intervening elements may be present; when an element is referred to as being "installed onto" another element, it can be directly installed onto the other element, or intervening elements may be present; when an element is referred to as being "disposed on" another element, it can be directly disposed on the other element, or intervening elements may be present.

As shown in FIGS. 1 to 4, a lamp installed through screwing includes a lamp body 10 and an installing bracket 20. The lamp body 10 is provided with a first fastening part 11 thereon. The installing bracket 20 is provided with a second fastening part 21 thereon. The first fastening part 11 is inserted into the second fastening part 21, and the lamp body 10 is screwed, and the first fastening part 11 turns to fixedly fit the second fastening part 21.

During the installation of the lamp, the installing bracket 20 is firstly fixed at the installation location. After the installing bracket 20 is installed, the first fastening part 11 of the lamp body 10 is positioned to be aligned with the second fastening part 21 of the installing bracket 20 and then inserted into the second fastening part 21. Thereafter, the lamp body 10 is screwed. The rotation of the lamp body 10 drives the first fastening part 11 to rotate, and the first fastening part 11 rotates to fixedly fit the second fastening part 21, thus the installation of the lamp body 10 is completed. During the replacement of the lamp body 10, since the installing bracket 20 has been installed previously in the installation process, the lamp body 10 may be directly fixed by screwing without using any bolt, thus greatly saving the installation time and facilitating the installation.

Figure 4:
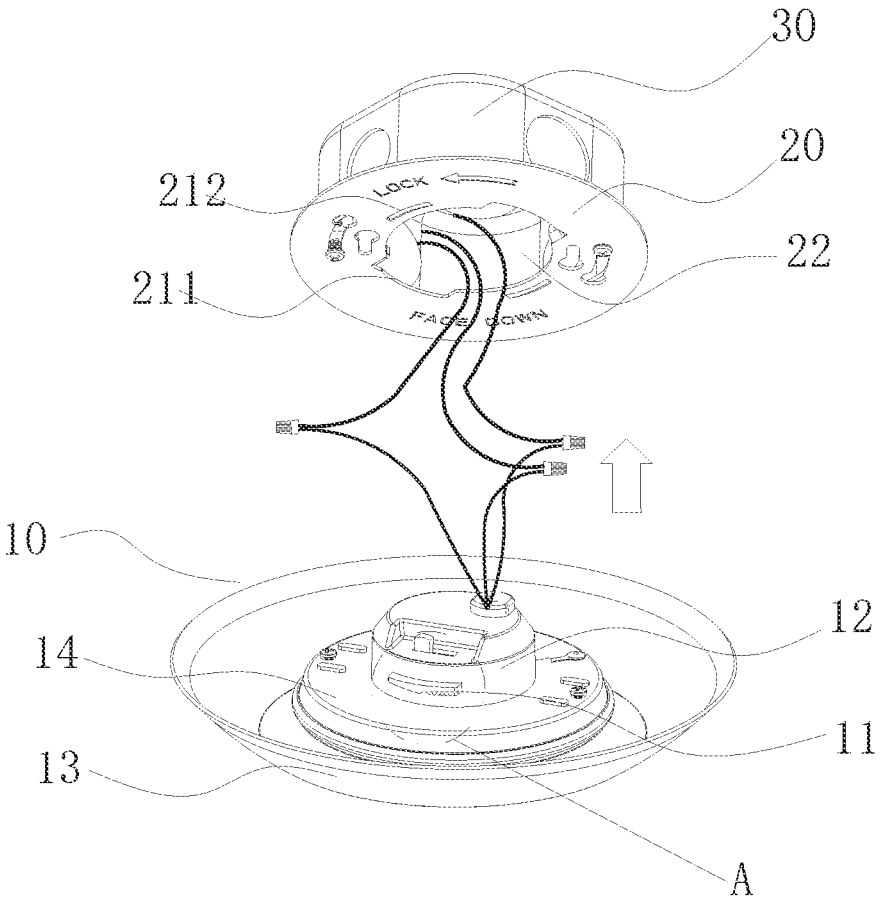
FIG. 4 is a schematic perspective structural view showing a fit between a lamp body and the installing bracket according to an embodiment of the present application.

As shown in FIG. 4, in this embodiment, the lamp body 10 includes a lamp shade 13, and a lamp source component 14 fixedly connected to the lamp shade 13. The lamp shade 13 can ensure the aesthetic appearance of the lamp body 10. Moreover, the configuration of the present solution avoids directly removing the lamp shade 13 and then fixing the lamp body 10 to the installing bracket 20 via the bolt. In the manner of using the bolt, not only the screwing is troublesome, but the installation may be performed only after the lamp shade 13 is removed. Therefore, the configuration of the present solution has prominent advantages.

The first fastening part 11 fits the second fastening part 21 by means of a press. The fit manner by means of a press may increase the friction force between the first fastening part 11 and the second fastening part 21, thus effectively preventing them from being loose.

The second fastening part 21 is provided with a hole region 211 and a protrusion region 212. The first fastening part 11 passes through the hole region 211 and then is screwed to fit the protrusion region 212 by means of a press. The first fastening part 11 passes through the hole region 211 and then is screwed to fit the protrusion region by means of a press, thereby completing the fixation.

Figure 3:
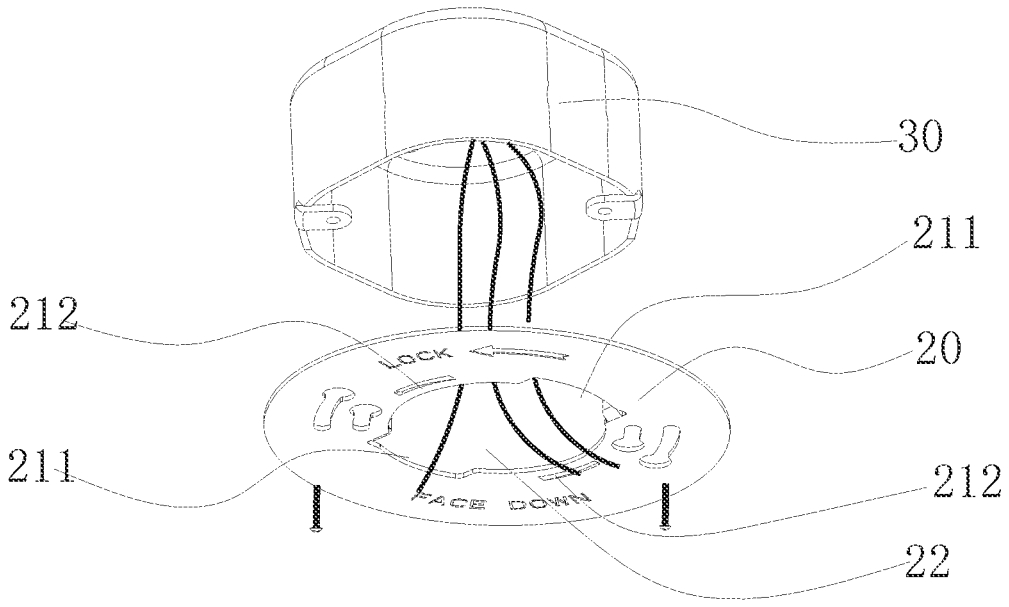
FIG. 3 is a schematic perspective structural view showing a fit between the installing bracket and the installing seat according to an embodiment of the present application.
Figure 5:
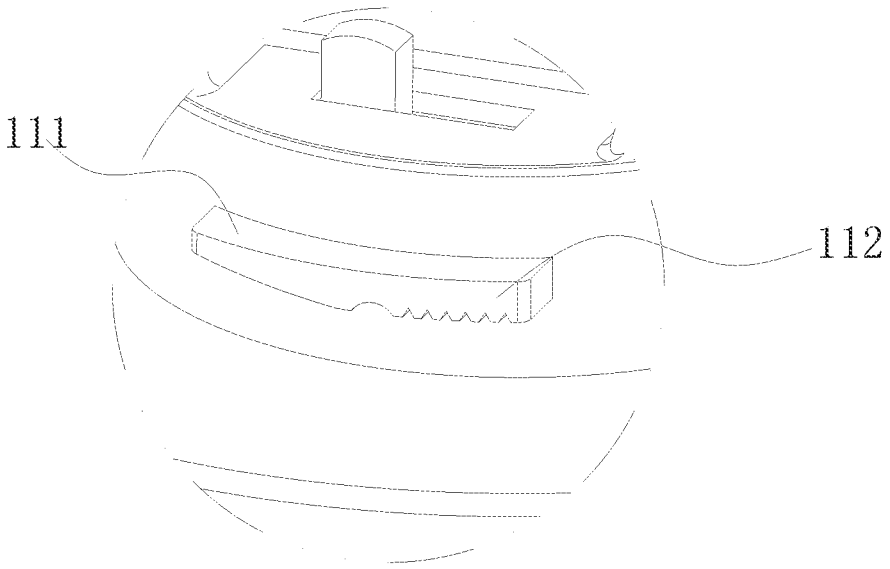
FIG. 5 is an enlarged schematic view of a structure at a region A in FIG. 4 according to an embodiment of the present application.
Figure 6:
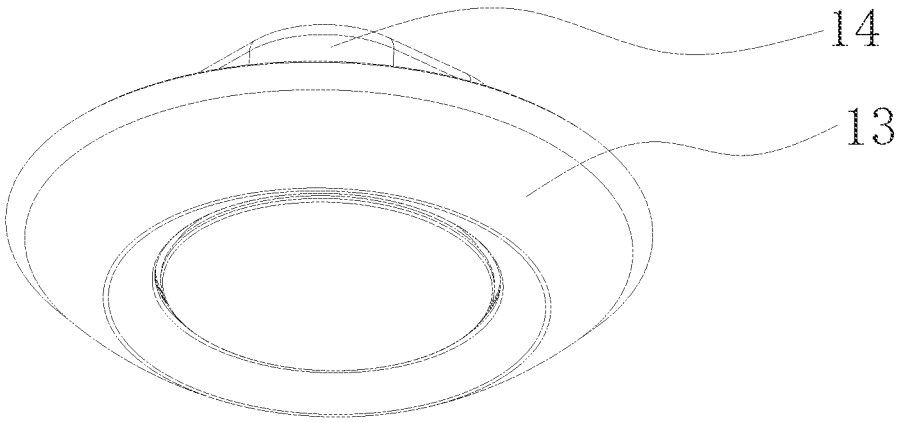
FIG. 6 is a schematic perspective structural view of the lamp body and the installing bracket installed together according to an embodiment of the present application.

Specifically, as shown in FIGS. 3 to 5, the lamp body 10 is provided with a protruding installation chamber thereon. The first fastening part 11 protrudes along a perimeter wall of the installation chamber. A dodging hole 22 is defined at the center of the installing bracket 20. The hole region 211 is provided on a side wall of the dodging hole 22. The installation chamber passes through the dodging hole 22, the first fastening part 11 passes through the installing bracket 20 along the hole region 211. The lamp body 10 rotates to have the first fastening part 11 fit the protrusion region 212 by means of a press. The installation chamber may be provided with a circuit board therein and then electrically connected to the outside via power lines. During the installation, the installation chamber passes through the dodging hole 22, and then the first fastening part 11 arranged outside the installation chamber passes through the hole region 211 and then is screwed to press the protrusion region 212 to complete the fit.

As shown in FIG. 5, the first fastening part 11 has a first end 111 and a second end 112 arranged along a rotation direction of the lamp body 10. The thickness of the first fastening part 11 is gradually increased from the first end 111 to the second end 112. The second end 112 is provided with a jagged structure thereon. When the protrusion region 212 of the second fastening part 21 fits the first fastening part 11, the second fastening part 21 passes the first end 111 first, and continues to rotate, the pressure between the second fastening part 21 and the first fastening part 11 becomes larger, and thus the friction force therebetween becomes larger, and the clamping effect is better. When the first fastening part 11 moves to the second end 112 of the second fastening part 21, the jagged structure fits the first fastening part 11, thereby preventing the first fastening part 11 from sliding easily.

As shown in FIG. 3, a protruding rib is punched on the installing bracket 20. The rib forms the protrusion region 212. When the first fastening part 11 fits the second fastening part 21, the jagged structure of the second end 112 presses against the rib. The rib is resilient. The rib has resilience due to the property of the metal itself. Therefore, the rib has the resilience when it presses against and fits the first fastening part 11, thus preventing the sliding between the first fastening part 11 and the second fastening part 21.

As shown in FIGS. 1 and 3, the lamp installed through screwing further includes an installing seat 30 configured to be fixed onto a wall, on which the lamp is installed. The installing bracket 20 is fixedly installed on the installing seat 30. The installing seat 30 is used to be installed in advance before the installing bracket 20 is fixedly installed on the installing seat 30. The installing seat 30 may also be used to receive the reserved power lines.

During a practical installation, the installing bracket 20 may be fixed onto the installing seat 30 directly via a nail.

The lamp body 10 includes the lamp shade 13 and the lamp source component 14 fixedly connected to the lamp shade 13. The protruding installation chamber is disposed on the lamp source component 14. The protruding first fastening part 11 is disposed along the perimeter wall of the installation chamber.

Figure 7:
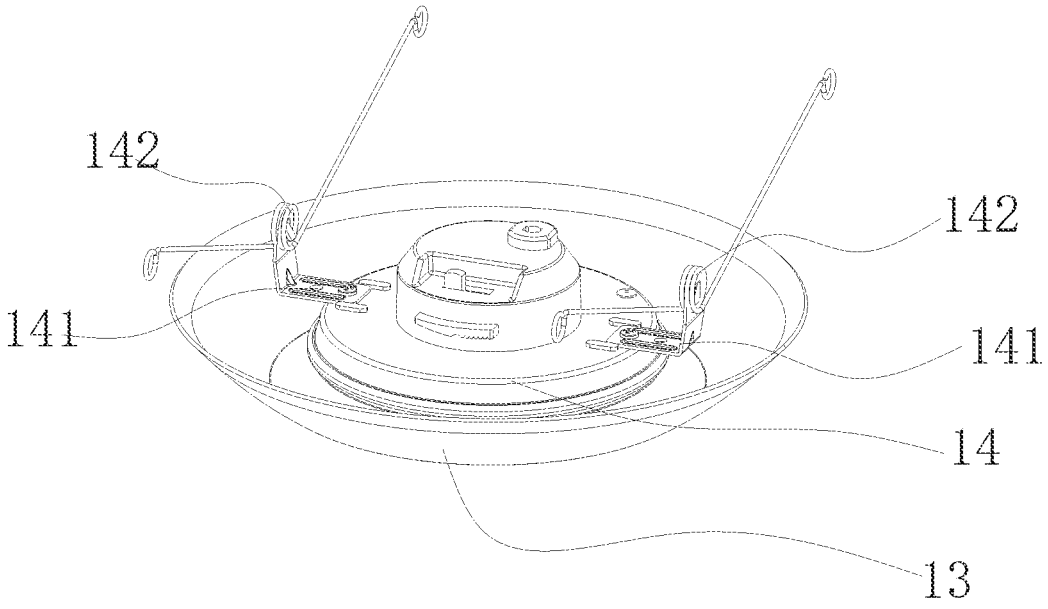
FIG. 7 is a schematic perspective structural view of the lamp body installed with torsional springs according to an embodiment of the present application.
Figure 8:
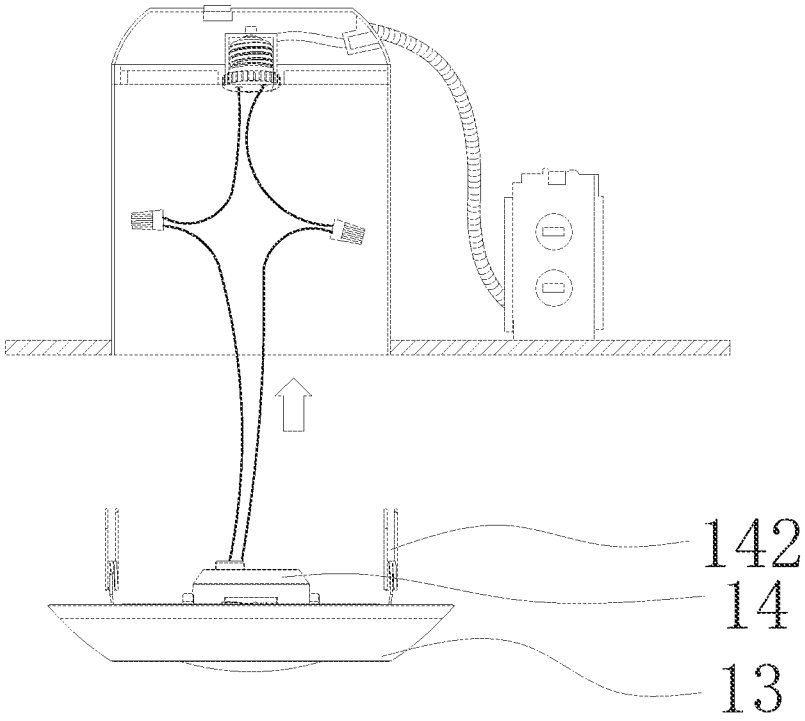
FIG. 8 is a schematic view illustrating the fitting relationship of the lamp body installed with the torsional springs according to an embodiment of the present application.

As shown in FIG. 7 and FIG. 8, in other embodiments, two protruding lugs 141 are symmetrically disposed on the lamp source component 14. Each protruding lug 141 is provided with one torsional spring thereon. In this case, the protruding lugs 141 are directly installed at the reserved location on the lamp source component 14, and then the torsional springs are installed and configured to mount a downlight.

When the description is made with reference to a figure, new features are to be described. In order to avoid repeated reference to the figure which will cause the description unconcise, the figure will not be referred to one by one when the features which have been described are clear.

The objective of the above embodiments is to re-present and deduce the technical solutions of the present application by means of examples, thereby completely describing the technical solutions, the objectives, and the effects of the present application, so as to make the disclosure of the present application to be understood more thoroughly and comprehensively by the public, but is not intended for limitation on the protection scope of the present application.

The above embodiments are not based on the exhaustive list of the present application, in addition, there may be other multiple unlisted embodiments. Therefore, any replacements and modifications made without departing from the concept of the present application are within the protection scope of the present application.

What is claimed is:

1. A lamp installed through screwing, comprising a lamp body and an installing bracket, wherein:

the lamp body is provided with a first fastening part thereon, wherein the lamp body is provided with a protruding installation chamber thereon, the first fastening part is configured to protrude along a perimeter wall of the installation chamber;

the installing bracket is provided with a second fastening part thereon, wherein the second fastening part is provided with a hole region and a protrusion region, a dodging hole is defined at a center of the installing bracket, the hole region is provided on a side wall of the dodging hole; and the installation chamber is configured to pass through the dodging hole, the first fastening part is configured to pass through the installing bracket along the hole region, and the lamp body is turned to have the first fastening part fit the protrusion region by means of a press.

2. The lamp installed through screwing of claim 1, wherein the first fastening part has a first end and a second end arranged along a rotation direction of the lamp body; a thickness of the first fastening part is gradually increased from the first end to the second end; and the second end is provided with a jagged structure thereon.

3. The lamp installed through screwing of claim 2, wherein a protruding rib is punched on the installing bracket, the protruding rib forms the protrusion region, and the jagged structure on the second end presses against the rib when the first fastening part fits the second fastening part.

4. The lamp installed through screwing of claim 3, wherein the lamp body comprises a lamp shade, and a lamp source component fixedly connected to the lamp shade.

5. The lamp installed through screwing claim 4, wherein two protruding lugs are symmetrically disposed on the lamp source component, each of the two protruding lugs is provided with a torsional spring thereon.

6. The lamp installed through screwing of claim 3, wherein the rib is resilient.

7. The lamp installed through screwing of claim 1, further comprising an installing seat configured to be fixed onto a wall, on which the lamp is installed, wherein the installing bracket is fixedly installed on the installing seat.

8. The lamp installed through screwing of claim 7, wherein the installing bracket is fixed onto the installing seat directly via a nail.

9. The lamp installed through screwing of claim 1, wherein the installation chamber is provided with a circuit board therein and electrically connected to an outside via power lines.

* * * * *